US006501933B2

(12) United States Patent
Ishii

(10) Patent No.: US 6,501,933 B2
(45) Date of Patent: Dec. 31, 2002

(54) DEVELOPING CARTRIDGE WITH AGITATOR DRIVEN TO ROTATE INDEPENDENT FROM DEVELOPING ROLLER

(75) Inventor: Masahiro Ishii, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/866,739

(22) Filed: May 30, 2001

(65) Prior Publication Data

US 2001/0050706 A1 Dec. 13, 2001

(30) Foreign Application Priority Data

Jun. 2, 2000 (JP) ..... 2000-166380

(51) Int. Cl.[7] ..... G03G 15/08; G03G 15/00

(52) U.S. Cl. ..... 399/254; 399/27; 399/64; 399/75; 399/111

(58) Field of Search ..... 399/27, 61, 64, 399/75, 119, 120, 252, 254, 111

(56) References Cited

U.S. PATENT DOCUMENTS 5,243,389 A * 9/1993 Yamane et al. ..... 399/254
5,530,530 A * 6/1996 Tanaka et al. ..... 399/64
5,649,264 A * 7/1997 Domon et al. ..... 399/27 X
5,655,175 A * 8/1997 Oshida ..... 399/27
5,784,669 A * 7/1998 Miura et al. ..... 399/61 X
5,958,640 A * 9/1999 Hasegawa et al. ..... 399/252 X
6,041,350 A 3/2000 Suzuki et al. ..... 399/111
6,101,350 A 8/2000 Suzuki et al. ..... 399/113

FOREIGN PATENT DOCUMENTS

JP 02-018583 * 1/1990
JP 06-003950 * 1/1994
JP 06-043758 * 2/1994

* cited by examiner

*Primary Examiner*—Sophia S Chen
(74) *Attorney, Agent, or Firm*—Oliff & Berridge, PLC

(57) ABSTRACT

To provide age forming device and a developing cartridge used in the image forming device capable of performing high-speed image forming operation for forming high-quality images and of reliably detecting an accurate amount of remaining toner. An agitator and a developing roller provided to a developing cartridge are driven to rotate independent from each other. During the detection of the remaining toner amount, the agitator is rotated at a lower speed so as not to stir up the toner. On the other hand, the agitator is rotated at a higher speed during the image forming operations, so that the toner efficiently circulates within the developing cartridge, thereby forming preferable images.

20 Claims, 5 Drawing Sheets

DEVELOPING CARTRIDGE WITH AGITATOR DRIVEN TO ROTATE INDEPENDENT FROM DEVELOPING ROLLER

BACKGROUND OF THE INVENTION

1. Field of the Invention

The present invention relates to an image forming device and a developing cartridge mounted on the image forming device.

2. Related Art

There has been provided an image forming device, such as a laser beam printer. A developing cartridge is mounted on the conventional laser beam printer. The developing cartridge includes a toner chamber, an agitator, a developing roller, a regulation blade, and a photosensitive drum.

The toner chamber houses a non-magnetic single component toner. The agitator is provided within the toner chamber for agitating the toner and for supplying the toner onto the developing roller. The toner supplied to .the developing roller is held on its peripheral surface and forms a toner layer thereon. The regulation blade regulates the thickness of the toner layer, and also charges the toner by friction.

The photosensitive drum is provided in confrontation with the developing roller, and an electrostatic latent image is formed thereon. When the rotation of the developing roller transports the toner layer to the photosensitive drum, charged toner is selectively transferred from the developing roller onto the photosensitive drum, thereby developing a visible toner image corresponding to the electrostatic latent image on the photosensitive drum.

In this type of laser beam printer, a photosensor is provided for detecting the amount of the toner remaining in the toner chamber. The photosensor includes a light emitting element and a light receiving element provided each side of the toner chamber so as to interpose the toner chamber therebetween. The toner chamber is formed with light transmission windows through which a light emitted from the light emitting element reaches the light receiving element.

The agitator rotates and lifts up the toner for agitation at a predetermined frequency. Therefore, the lifted-up toner temporarily blocks the light from reaching the light receiving element at the predetermined frequency. Both the time duration for letting the light to transmit to and reach the light receiving element and the time duration for blocking the light from reaching the light receiving element depend on the amount of the remaining toner. Accordingly, by detecting the time duration of the light transmission, the reaming amount of the toner can be detected.

The laser beam printer is usually provided with a motor serving as a driving power source. The driving power of the motor is transmitted to both the developing roller and the agitator via a transmission gear mechanism, thereby driving the developing roller and the agitator to rotate.

There has been also provided a laser beam printer capable of printing at a high speed rate. In order to increase the printing speed, it is required to rotate the agitator and the developing roller at higher speed. High-speed rotation of the agitator efficiently agitates or circulates the toner within the toner chamber, and so an increased amount of toner, which is efficiently charged, is supplied to the developing roller. Also, high-speed rotation of the developing roller efficiently develops visible toner images corresponding to electrostatic latent images on the photosensitive drum.

However, high-speed rotation of the agitator stirs up the toner, and fills the toner chamber with clouds of toner. This cloud of toner blocks the light of the photosensor from reaching the light receiving element, regardless of the remaining toner amount, thereby preventing accurate detection of remaining toner amount.

In order to overcome the above problems, it is conceivable to rotate the agitator at higher speed during printing and at lower speed during toner amount detection. However, because the agitator is driven by a driving mechanism that also drives the developing roller, when the rotation speed of the agitator is slowed down, the rotation speed of the developing roller is also slowed down. The change in rotation speed of the developing roller changes the developing condition, resulting in undesirable printed image, such as, redundancy in printing.

SUMMARY OF THE INVENTION

It is an objective of the present invention to overcome the above problems and also to provide an image forming device and a developing cartridge used in the image forming device capable of detecting an accurate amount of remaining toner and forming high quality image at high speed.

In order to achieve the above and other objectives, there is provided a developing cartridge used in an image forming device. The developing cartridge includes a chamber that is rotatable and houses a developing agent, a holding member that holds the developing agent, an agitator that is rotatably provided within the chamber, and agitates the developing agent, and supplies the developing agent to the holding member, The holding member and the agitator rotate independent from each other.

There is also provided an image forming device, including a chamber that houses a developing agent, a holding member that holds the developing agent, an agitator that is provided within the chamber and agitates the developing agent, an agitator driving mechanism that drives the agitator to rotate at different speed. The holding member and the agitator rotate independent from each other.

Further, there is provided an image forming device including a chamber that houses a developing agent, a holding member that rotates and holds the developing agent, an agitator that rotates within the chamber to agitate the developing agent, a sensor that detects an amount of the developing agent remaining in the chamber, and an image forming mechanism that performs an image forming operation. The agitator rotates independent from the holding member. The agitator rotates at a lower speed when the sensor detecting the amount of the developing agent than when the sensor is undetecting the amount of the developing agent.

There is also provided a developing cartridge used in an image forming device, including a chamber that houses a developing agent, a holding member that is rotatable and holds the developing agent, an agitator that is rotatable provided within the chamber, agitates the developing agent, and supplies the developing agent to the holding member, and windows formed to the chamber. The windows defines a light transmitting path. The holding member and the agitator rotate independent from each other.

BRIEF DESCRIPTION OF THE DRAWINGS

In the drawings:

FIG. 6(*b*) is a timing chart of an output signal output when there is sufficient amount of toner;

FIG. 6(*c*) is a timing chart of an output signal output when it is detected there is only small amount of toner; and FIG. 6(*d*) is a timing chart of an output signal output when it is detected there is no toner.

PREFERRED EMBODIMENT OF THE PRESENT INVENTION

Next, a laser beam printer according to an embodiment of the present invention will be described in detail while referring to the accompanying drawings.

Figure 1:
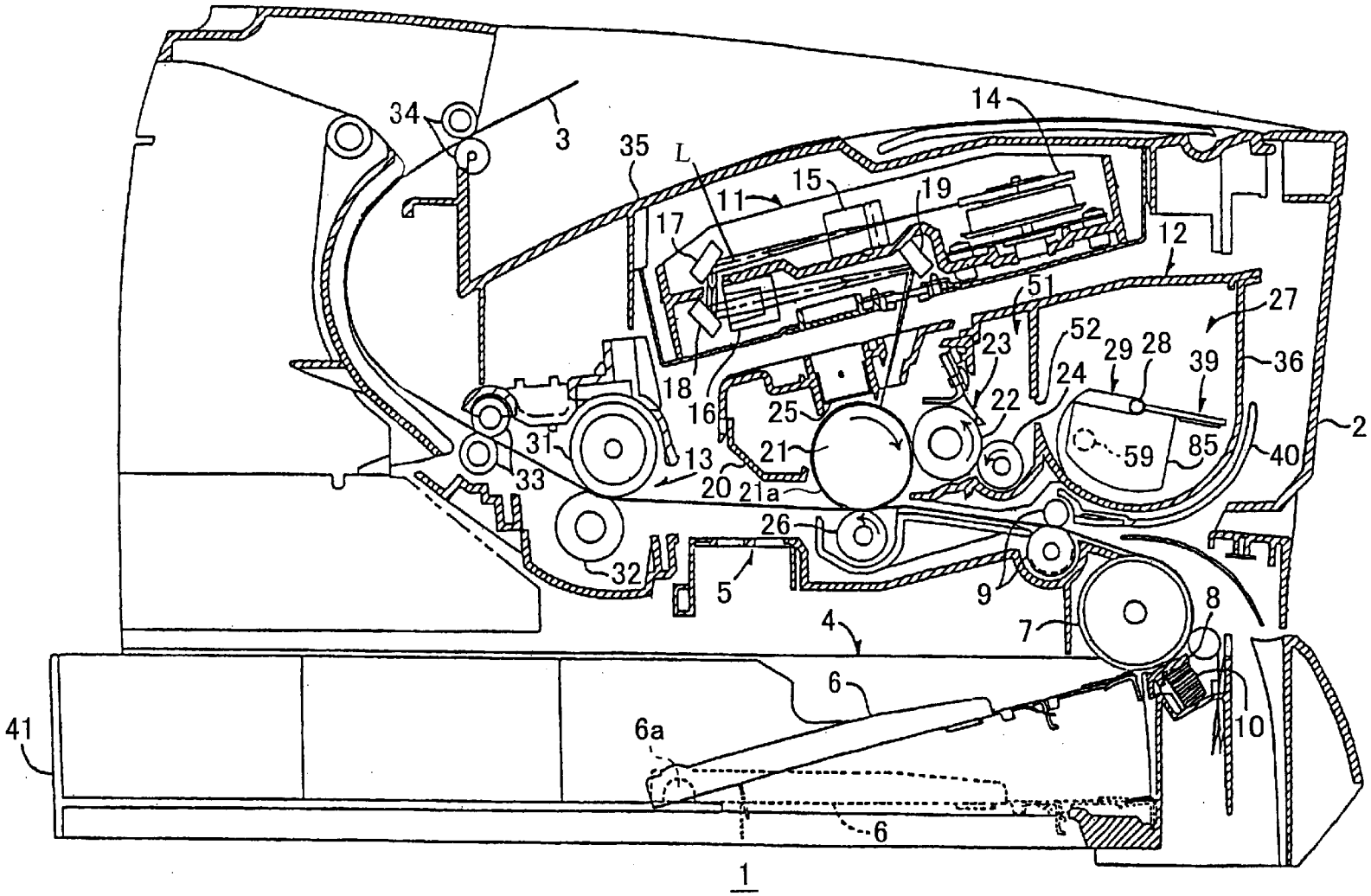
FIG. 1 is a cross-sectional view showing a laser beam printer including a developing cartridge according to an embodiment of the present invention.

As shown in FIG. 1, a laser beam printer 1 according to the present embodiment includes a main casing 2, a feeder unit 4, and an image forming unit 5. The feeder unit 4 and the image forming unit 5 are both housed within the main casing 2.

The feeder unit 4 is for feeding a recording sheet 3, and includes a sheet tray 41 detachably mounted at the bottom of the main casing 2. The feeder unit 4 also includes a sheet pressing plate 6, a sheet supply roller 7, a sheet feed pad 8, register rollers 9, and a spring 10. The sheet pressing plate 6 is provided inside the sheet tray 41. The sheet supply roller 7 and the sheet feed pad a are provided above one side of the sheet tray 41. The register rollers 9 are provided downstream from the sheet supply roller 7 in a sheet feed direction of the recording sheet 3.

The sheet pressing plate 6 supports thereon a stack of the recording sheets 3. The sheet pressing plate 6 is pivotal about its pivot point 6*a* at one side separated away from the sheet supply roller 7, so the other side near the sheet supply roller 7 is movable upward and downward. Although not shown in the drawings, a spring is provided beneath the sheet pressing plate 6 and urges the sheet pressing plate 6 upward. Accordingly, an upper most one of the recording sheets 3 mounted on the sheet pressing plate 6 is pressed against the sheet supply roller 7. With this configuration, an increased amount of the recording sheets 3 mounted on the sheet pressing plate 6 presses the sheet pressing plate 6 downward, so the sheet pressing plate 6 pivots downward about the pivot point 6*a* against the urging force of the spring.

The sheet supply roller 7 and the sheet feed pad 8 are provided in confrontation with each other. The spring 10 is provided beneath the sheet feed pad 8 and urges the sheet feed pad 8 toward the sheet supply roller 7. Rotation of the sheet supply roller 7 separates the upper most recording sheet 3 on the sheet pressing plate 6 from remaining recording sheets 3. The separated recording sheet 3 is nipped between the sheet supply roller 7 and the sheet feed pad 8, and then is transported in the sheet feed direction.

The register rollers 9 include a driving roller and a slave roller. The register rollers 9 register the recording sheet 3 supplied from the sheet supply roller 7, and then further transports the recording sheet 3 to the image forming unit 5.

The image forming unit 5 includes a scanner unit 11, a developing unit 12, and a fixing unit 13. The scanner unit 11 is provided at the upper portion of inside the main casing 2, and includes a laser generator (not shown), a polygon mirror 14 that is driven to rotate, lenses 15 and 16, reflection mirrors 17, 18, and 19. The laser generator generates a laser light L based on image data. The laser light L is transmitted through and via the polygon mirror 14, the lens 15, the reflection mirrors 17 and 18, the lens 16, and the reflection mirror 19 in this order as indicated by a dotted line in FIG. 1, and reaches a drum surface 21*a* of a photosensitive drum 21 (described later) at a high-scanning speed.

Figure 2:
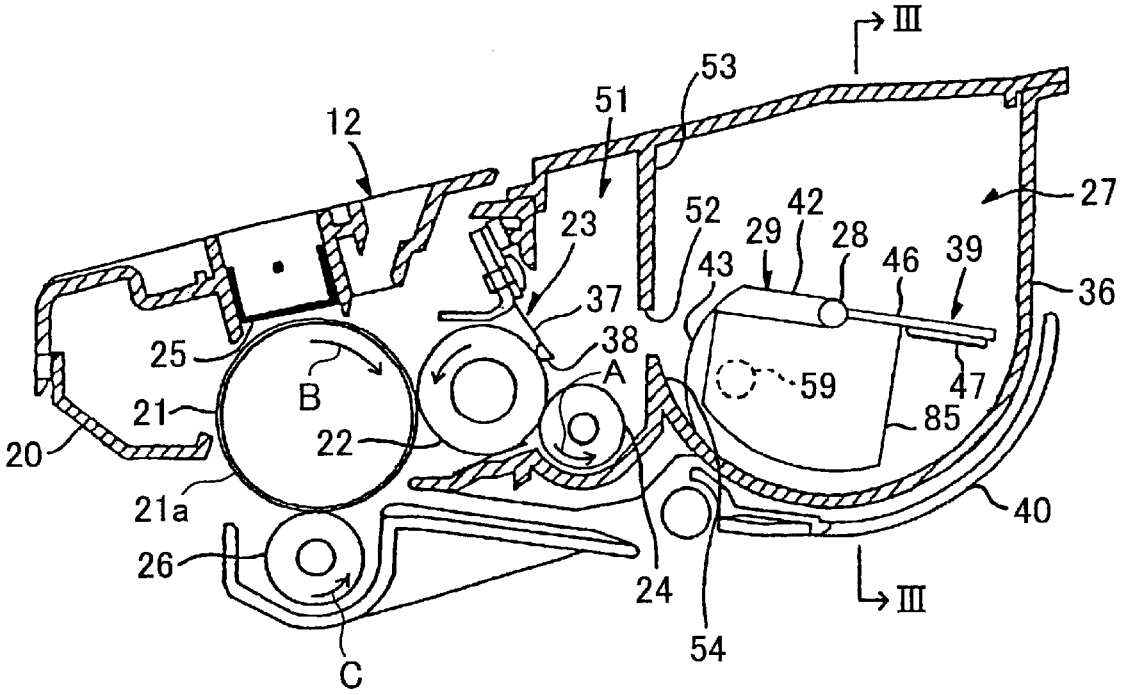
FIG. 2 is a magnified cross-sectional view showing a developing unit of the laser beam printer of FIG. 1.

The developing unit 12 is provided below the scanner unit 11. As shown in FIG. 2, the developing unit 12 includes a drum cartridge 20 detachably mounted onto the main casing 2, and a developing cartridge 36 detachably mounted onto the drum cartridge 204 The drum cartridge 20 includes the photosensitive drum 21, a transfer roller 26, and a scorotoron charge unit 25. The developing cartridge 36 is separable from the photosensitive drum 21 and the scorotoron charge unit 25.

Inside the developing cartridge 36 is defined with a toner chamber 27 for housing toner, and a developing chamber 51 in which the toner image is developed. The developing chamber 51 and the toner chamber 27 are separated by an upper separation wall 53 and a lower separation wall 54, which define a substantially-rectangular-shaped opening. 52 therebetween. The opening 52 extends, in a widthwise direction of the laser beam printer 1, that is, in a direction perpendicular to the sheet surface of FIG. 2. The opening 52 enables the toner to circulate between the toner chamber 27 and the developing chamber 51.

Also, as shown in FIG. 2, inside the toner chamber 27 are provided with an agitator 29, a pair of wipers 39 (only one is shown in FIG. 2), and a rotation shaft 28. The agitator 29 agitates the toner inside the toner chamber 27 and supplies the toner to the developing chamber 51 through the opening 52. The wipers 39 are for wiping light transmission windows 58 and 59 to be described later. The rotation shaft 28 supports both the agitator 29 and the wipers 39.

It should be noted that the toner is a positively chargeable, non-magnetic, single-component polymerized toner, which is configured by adding silica as an outer additive to the surface of toner base particles. The toner base particles have a particle diameter of between 6 microns and 10 microns. The toner base particles are formed by adding a well-known coloring agent, such as carbon black, a charge control agent, such as nigrosine, and wax, to styrene acryl resin formed in spheres. The styrene acryl resin is formed by well-know polymerization, such as suspension polymerization, for copolymerizing polymerizable monomer. The monomer may be styrene monomer, such as styrene, and acryl monomer, such as alkyl (C1–C4), acryrate, alkyl (C1–C4) meta acryrate, and the like.

Such polymerized toner has uniform toner base particles with a shape extremely close to sphere, so the toner has an excellent fluidly. Therefore, agitation by the agitator 29 efficiently circulates the toner within the developing cartridge 36, and charging efficiency is improved, resulting in excellent image forming.

Positively-charged toner image can be developed on the positively charged photosensitive drum 21. This provides following advantage. That is, when a negatively-chargeable toner is used, a negatively-charged toner image is developed on a negatively-charged photosensitive drum. In this case, at the time of when the scorotoron charge unit 25 negatively charges the photosensitive drum 21 without contacting the photosensitive drum 21, a large amount of ozone is generated. In order to prevent generation of ozone, a conductive roller or blush may be used, instead of the scorotoron charge unit 25, for negatively charging the photosensitive drum 21 while directly contacting the photosensitive drum 21. However, because the conductive roller or the blush directly contacts the photosensitive drum 21, the photosensitive drum 21 cannot be charged evenly.

However, the scorotoron charge unit 25 positively charges the photosensitive drum 21 without contacting the photosensitive drum 21 while hardly generating ozone. Because, the scorotoron charge unit 25 does not contact the photosensitive drum 21, the photosensitive drum 21 can be uniformly charged.

Figure 3:
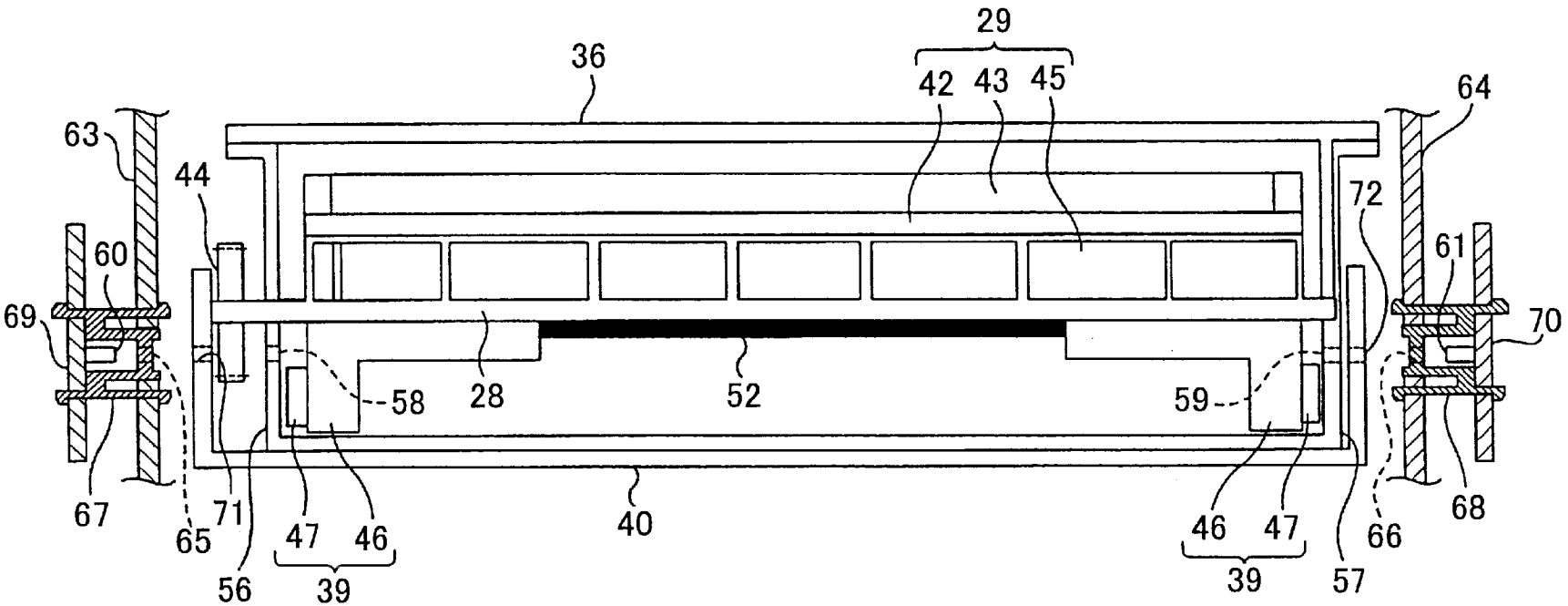
FIG. 3 is a cross-sectional view showing a toner chamber of the developing unit taken along the line III—III in FIG. 2.

FIG. 3 is a cross-sectional view showing inside the toner chamber 27 taken along a line III—III in FIG. 2. It should be noted that in order to facilitate the explanation, the wipers 39 and the agitator 29 in FIG. 3 are positioned at positions rotated from that shown in FIG. 2 in the clockwise direction by about 90 degrees.

As shown in FIG. 3, the rotation shaft 28 is positioned at the center of the toner chamber 27 and extends between a pair of side walls 56, 57 of the toner chamber 27 One end of the rotation shaft 28 penetrates through the side wall 56 and protrudes outwardly form the side wall 56. A gear 44 is provided to the protruding portion of the rotation shaft 28. The gear 44 rotates the rotation shaft 28.

As shown in FIGS. 2 and 3, the agitator 29 is provided to the rotation shaft 28 so as to extend along the lengthwise direction thereof. The agitator 29 includes a support member 42 and a sliding member 43. The support member 42 is formed from resin and extends from the rotation shaft 28 outwardly in its radial direction. The support member 42 is formed with a plurality of openings 45 arranged with a predetermined interval in its lengthwise direction. The sliding member 43 is a film formed from polyethylene telephthalate and the like, and is provided to a free end of the support member 42.

Rotation of the rotation shaft 28 rotates the agitator 29 within the toner chamber 27. At this time, the sliding member 43 deforms and slides along the bottom surface of the toner chamber 27, which is formed in substantially cylindrical shape, thereby lifting up the toner. The lifted toner is then supplied into the developing chamber 51 through the opening 52. When the agitator 29 rotates, the support member 42 also lifts up the toner as well as the sliding member 43. However, because of the openings 45, toner resistance onto the agitator 29 is reduced.

The wipers 39 are provided at positions interposing the agitator 29 therebetween, and have a phase angle of 180 degrees with the agitator 29. Each of the wipers 39 includes a support member 46 and a cleaning member 47. The support member 46 is formed from resin and extends from the rotation shaft 28 outward in its radial direction. The cleaning member 47 is formed from urethane rubber and the like and provided at the side of the support member 46.

When the wipers 39 rotate inside the toner chamber 27 along with the rotation of the rotation shaft 28, the cleaning members 47 contact the light transmission windows 58 and 59, and wipe off the toner clinging on the light transmission windows 58 and 59. Because both the agitator 29 and the developing cartridge 36 are supported on the single rotation shaft 26, the wipers 39 can wipe the light transmission windows 58 and 59 at the rotation frequency of the agitator 29, regardless of the rotation speed of the agitator 29. Therefore, a photosensor 62 to be described later can accurately detect the remaining amount of the toner.

It should be noted that as shown in FIG. 2, the agitator 29 is provided with a fan-shaped shade plate 85. As will be described later, the shade plate 85 increases the time duration for blocking the light of the photosensor 62. This reduces erroneous detection, thereby enabling accurate detection.

As shown in FIG. 2, inside the developing chamber 51 are provided with a developing roller 22, a regulation blade 23, and a supply roller 24. The supply roller 24 is positioned near the opening 52 and rotatable in a counterclockwise direction indicated by an arrow A. The supply roller 24 and the developing roller 22 contact each other so that the both pressingly deform by some amount.

The supply roller 24 has a roller body wound around a metal shaft. The roller body is formed from a foam material having electrical conductivity.

The developing roller 22 is applied with a bias voltage that generates potential difference between the developing roller 22 and the photosensitive drum 21. The developing roller 22 has a roller body wound around a metal shaft. The roller body has electrical conductivity, and is formed from a rubber material, such as urethane rubber and silicon rubber. containing carbon particles and the like. A coat layer of urethane rubber or silicon rubber containing negatively-chargeable fluorine is formed on the peripheral surface of the rubber body of the developing roller 22, The negatively-chargeable fluorine in the coat layer improves positive charge of the toner held on the developing roller 22.

The regulation blade 23 is provided near the developing roller 22. The regulation blade 23 includes a blade body 37 formed from a metal leaf spring and a pressing member 38 provided at a tip end of the blade body 37. The pressing member 38 is formed in a semispherical shape from silicon rubber. The other end of the blade body 37 is supported to a frame of the developing cartridge 36 at a position near the developing roller 22. The resilient force of the blade body 37 presses the pressing member 38 against the developing roller 22.

The rotation of the supply roller 24 supplies the developing roller 22 with the toner, which has been supplied into the developing chamber 51 from the toner chamber 27. At this time, the friction between the developing roller 22 and the supply roller 24 positively charges the toner. When the toner on the developing roller 22 reaches the regulation blade 23 as the developing roller 22 rotates, the toner is rubbed between the developing roller 22 and the pressing member 38 of the regulation blade 23, and a toner layer having a predetermined thin thickness is formed on the developing roller 22. At the same time, the toner is sufficiently charged by friction.

It should be noted that the outer additives of the toner, such as silica, becomes embedded into the toner base particles when the toner is rubbed between the pressing member 38 and the developing roller 22. This reduces the fluidity and chargeability of the toner. Therefore, during the image forming operations, it is necessary to maintain the rotational speed of the agitator 29 faster than a predetermined minimum speed in order to efficiently circulate the toner within the developing cartridge 36, so that improper printing of images due to degraded toner piling up can be prevented.

Next, a driving mechanism of the developing cartridge 36 will be described while referring to FIG. 4. According to the present embodiment, a driving mechanism for the agitator 29 and a driving mechanism for the developing roller 22 are unconnected from each other within the developing cartridge 36, and are formed independent from each other. Specifically, the developing cartridge 36 includes an agitator-side input gear 73 and a developing-roller-side input gear 74. The agitator-side input gear 73 is provided at a side of the toner chamber 27 in its widthwise direction, that is, in a direction perpendicular to the sheet surface of FIG. 4. The developing-roller-side input gear 74 is provided at a side of the developing chamber 51 in its widthwise direction, i.e., in the direction perpendicular to the sheet surface of FIG. 4.

The agitator-side input gear 73 engages the gear 44 of the rotation shaft 28. When the developing cartridge 36 is mounted onto the main casing 2, driving force from a sub-motor 75 (FIG. 5) provided inside the main casing 2 is supplied to the agitator-side input gear 73. That is, the driving force from the sub-motor 75 is transmitted to the gear 44 via the agitator-side input gear 73, and the gear 44 drives the rotation shaft 28 to rotate, thereby rotating the agitator 29 and the wiper 39 within the toner chamber 27.

Figure 4:
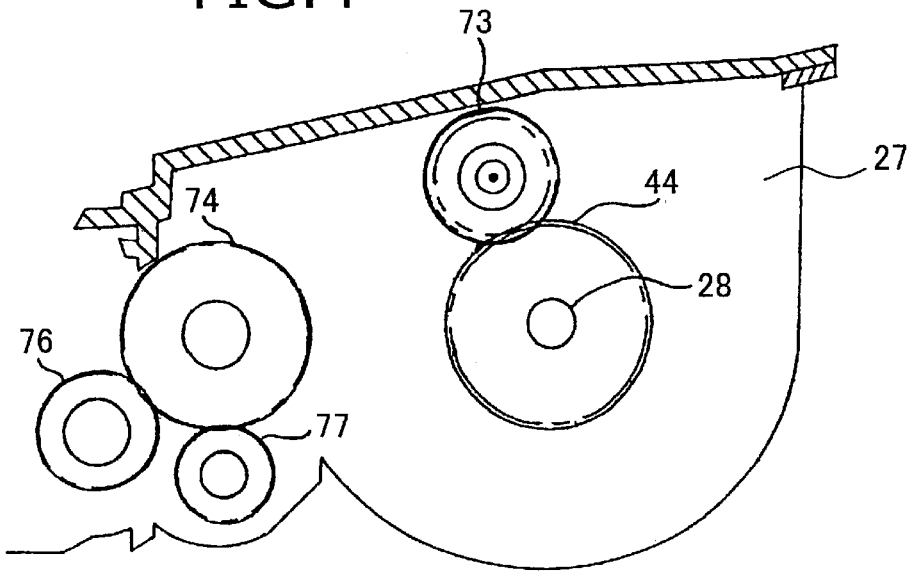
FIG. 4 a magnified cross-sectional view showing a driving mechanism of the developing cartridge.

As shown in FIG. 4, there are also provided a developing-roller gear 76 and a supply-roller gear 77 at positions near the developing-roller-side input gear 74, on roller shafts of the developing roller 22 and the supply roller 24, respectively. The developing-roller gear 76 and the supply-roller gear 77 both engage the developing-roller-side input gear 74. When the developing cartridge 36 is mounted onto the main casing 2, driving force from a main-motor 78 (FIG. 5) provided inside the main casing 2 is supplied to the developing-roller-side input gear 74. Accordingly, the driving force form the main-motor 78 is transmitted to the developing-roller gear 76 and the supply-roller gear 77 via the developing-roller-side input gear 74, and drives the developing-roller gear 76 and the supply-roller gear 77 to rotate the developing roller 22 and the supply roller 24.

It should be noted that in addition to the developing-roller-side input gear 74, the driving force from the main-motor 78 is also transmitted to and drives other various components, such as the photosensitive drum 21, the transfer roller 26, a pressing roller 31 to be described later, and the like. On the other hand, the driving force from the sub-motor 75 is exclusively for driving the agitator-side input gear 73.

Because the driving mechanism for driving the agitator 29 is separated from the driving mechanism for driving the developing roller 22. the sub-motor 75 and the main-motor 78 can be individually controlled without interfering with the other. Therefore, each of the agitator 29 and the developing roller 22 can be driven to rotate at its optimal condition. Details will be described later.

In FIG. 2, the photosensitive drum 21 is provided in confrontation with and at the side of the developing roller 22 in contact therewith so as to be rotatable in a clockwise 5 direction B. The photosensitive drum 21 includes a drum body connected-to the ground, and the surface of the drum body is formed from a positively-chargeable material, such as organic photosensitive member, whose main component is polycarbonate.

The scorotoron charge unit 25 is positioned above the photosensitive drum 21 at a position separated therefrom by a predetermined distance. The scorotoron charge unit 25 includes a charging wire, such as tungsten, that generates. corona discharge, and uniformly positively charges the drum surface 21*a* of the photosensitive drum 21.

After uniformly charged by the scorotoron charge unit 25, the drum surface 21*a* of the photosensitive drum 21 is exposed to the high-scanning laser light L emitted from the scanner unit 11. The laser light L selectively drops the electric potential on the drum surface 21*a*. As a result, the drum surface 21*a* is formed with an electrostatic latent image corresponding to image data.

When the positively charged toner on the rotating developing roller 22 is brought into contact with the drum surface 21*a*, the toner is selectively transferred onto the drum surface 21*a* at the portion whose electric potential has been decreased by exposure to the light L. As a result, a visible toner image is developed on the drum surface 21*a*. The developed toner image corresponds to the electrostatic latent image only reversed.

A transfer roller 26 is provided below and in confrontation with the photosensitive drum 21, and is rotatable in a counterclockwise direction C in FIG. 2. The transfer roller 26 includes a roller body wound around a metal shaft. The roller body is formed from a conductive rubber material. The transfer roller 26 is applied with a predetermined transfer bias voltage, so the toner image developed on the drum surface 21*a* is transferred onto the recording sheet 3 when the recording sheet 3 passes through between the photosensitive drum 21 and the transfer roller 26.

As shown in FIG. 1, the fixing unit 13 is positioned at the downstream side of the developing unit 12 in the sheet feed direction. The fixing unit 13 includes the pressing roller 31, a heat roller 32, and a pair of transport rollers 33. The pressing roller 31 presses against the beat roller 32. The heat roller 32 includes a halogen lamp made of a metal for generating heat. The pair of transport rollers 33 are provided downstream from the heat roller 32 and the pressing roller 31 in the sheet feed direction. When the recording sheet 3 passes through the nip portion between the heat roller 32 and the pressing roller 31, the heat roller 32 thermally fixes the toner image, which has been transferred onto the recording sheet 3 by the developing unit 12, onto the recording sheet 3. Then the transport rollers 33 transport the recording sheet 3 toward a pair of discharge rollers 34, which discharges the recording sheet 3 onto a discharge tray 35.

In the laser beam printer 1, residual toner remaining on the photosensitive drum 21 after the visible toner image is transferred onto the recording sheet 3 is collected in a cleaner-less method. In the cleaner-less method, the rotation of the photosensitive drum 21 brings the residual toner into confrontation with the scorotoron charge unit 25, and the scorotoron charge unit 25 uniformly and positively charges the residual toner. Then, the rotation of the photosensitive drum 21 further transports and brings the charged residual toner in confrontation with the developing roller 22. The bias voltage applied to the developing roller 22 collects the charged residual toner from the photosensitive drum 21 onto the developing roller 22. In this way, the residual toner is removed from the photosensitive drum 21.

Figure 5:
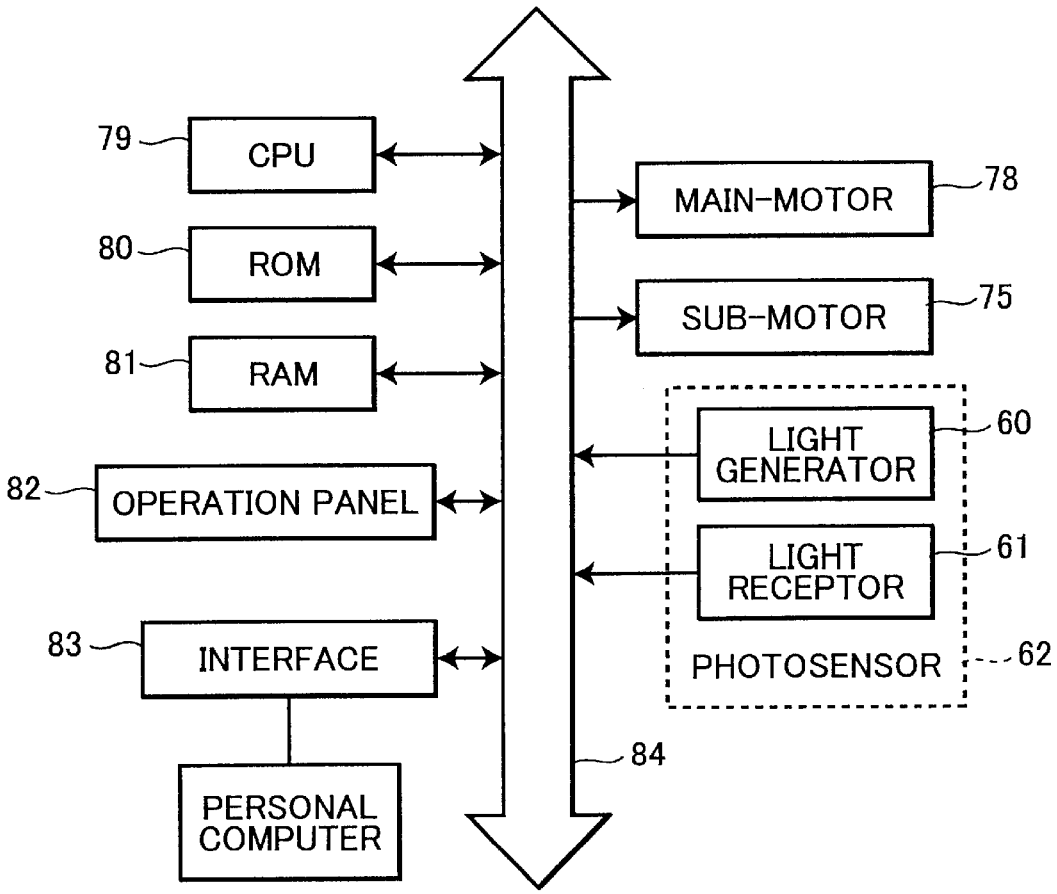
FIG. 5 is a block diagram showing a control mechanism of the laser beam printer.
Figure 6A:
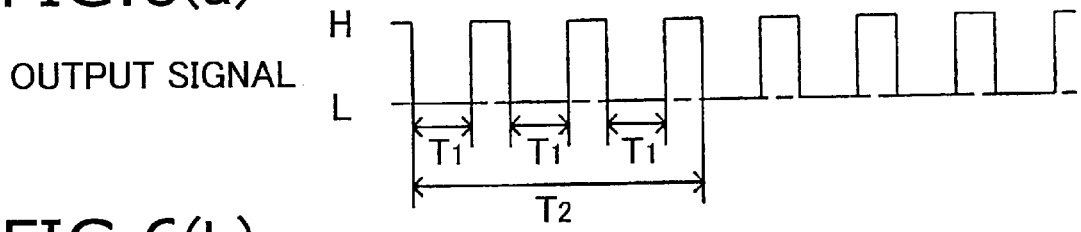
FIG. 6(*a*) is a timing chart of an output signal output from a light reception unit of a photosensor when there is no toner.
Figure 6B:
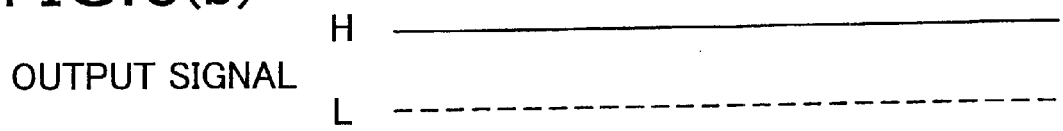
Figure 6C:
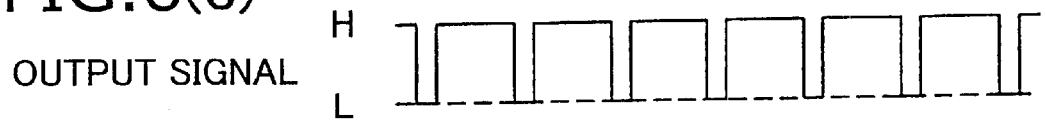
Figure 6D:
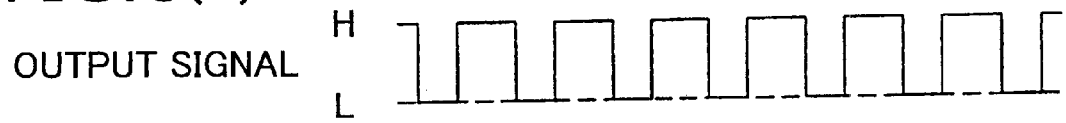

FIG. 5 shows a control configuration of the laser beam printer 1. As shown in FIG. 5, the laser beam printer 1 includes a central processing unit (CPU) 79 connected to a read only memory (ROM) 80, a random access memory (RAM) 81, an operation panel 82, an interface 83, the main-motor 78, the sub-motor 75, a light generator 60, and a light receptor 61 via a bas 84.

The ROM 80 stores various programs for forming images, a toner-remaining-amount detection program, an agitator-control program, and the like. The RAM 81 temporarily stores values and the like used in various programs. The operation panel 82 is provided with input keys for operating the laser beam printer 1, a LED for displaying various setting, and the like. The interface 83 monitors data transmitted to and received from external devices, such as personal computers.

The laser beam printer 1 is also provided with a toner empty sensor for detecting the amount of the toner remaining in the toner chamber 27.

As shown in FIG. 5, the toner empty sensor includes the photosensor 62 having the light generator 60 for generating a light and the light receptor 61 for receiving the light from the photo sensor 62. In FIG. 3, the pair of light transmission windows 58, 59 are formed to the pair of sidewalls 56, 57 in confrontation with each other, at positions between the center of the toner chamber 27 and the opening 52 in FIG. 1. The main casing 2 has frames 63 and 64 each confronting the corresponding light transmission window 58, 59, The frame 63 is embedded with a lens 65, and supports a supporting substrate 69 via a holder member 67 at outside thereof. The supporting substrate 69 supports the light generator 60 such that a light emitting element of the light generator 60 faces the lens 65.

Similarly, the frame 64 is embedded with a lens 66, and supports a supporting substrate 70 via a holder member 68 at outside thereof. The supporting substrate 70 supports the light receptor 61 such that a light receiving element of the light receptor 61 faces the lens 66.

As shown in FIG. 3, the drum cartridge 20 includes a casing 40 having a U-shaped cross section so as to surround the lower portion of the developing cartridge 36. The casing 40 is formed with a pair of openings 71, 72 at positions confronting the light transmission windows 58, 59.

That is, the light generator 60, the lens 65, the opening 71, the light transmission window 58, the light receptor 61, the lens 66, the opening 72, and the light transmission window 59 are arranged in a straight line. With this arrangement, the light from the light generator 60, which has a strong directivity, passes through the lens 65, the opening 71, the light transmission window 58, inside the toner chamber 27, and further the light transmission window 59, the opening 72, and the lens 66, and then reaches the light receptor 61.

However, when a sufficient amount of toner is remaining in the toner chamber 27, the toner blocks the light from the light generator 60 and prevents the light from reaching the light receptor 61. On the other hand, when only a small amount of toner or no toner remains in the toner chamber 27, the light from the light generator 60 reaches the light receptor 61 without being blocked by the toner. Therefore, the light receptor 61 receives a relatively large amount of light in this case.

When the light receptor 61 receives the light, the light receiving element of the light receptor 61 outputs a voltage as a signal in accordance with the amount of the received light. Specifically, when the received light amount is small, a high voltage, 5 V for example, is output, which is referred to as "high-level output signal". On the other hand, when the received light mount is large, a low voltage, such as 0 V, is output, which is referred to as "low-level output signal". Because the voltage output from the light receiving element changes in this manner, the light amount having passed through the toner chamber 27, i.e., the remaining toner amount in the toner chamber 27, can be detected based on the voltage output from the light receptor 61.

Next, control for detecting the toner remaining amount will be described. The detection of the toner remaining amount is executed by the toner-remaining-amount detection program stored in the ROM 80. The toner-remaining-amount detection program serves as a part of the toner empty sensor.

In the toner-remaining-amount detection program, the change in the output signal from the light receptor 61 within a unit of time is detected, and based on which the remaining toner amount is detected. The unit of time may be a predetermined rotation cycle of the agitator 29.

In addition to the toner remaining in the toner chamber 27, the rotating agitator 29 periodically blocks the light. Therefore, as shown in FIG. 6(*a*), when no toner remains in the toner chamber 27, the light receptor 61 outputs the high-level output signal and the low-level output signal in alternation at a predetermined time ratio in synchronization with the rotation of the agitator 29. On the other hand, when the sufficient amount of toner remains in the toner chamber 27, the light from the light generator 60 is blocked and does not reach the light receptor 61. Accordingly, as shown in rig. 6(*b*), the light receptor 61 outputs only the high-level output signal.

As the image forming process proceeds, the toner is consumed, and the toner remaining amount gradually decreases. When the toner amount decreases, the light from the light generator 60 is blocked by the toner only when the rotation of the agitator 29 lifts up the toner. As a result, the high-level output signal and the low-level output signal are output in alternation. At this time, when a large amount of toner is lifted up, the light is blocked for a relatively long time period. Accordingly, as shown in FIG. 6(*c*), the high-level output signal is output for a longer time period than the low-level output signal. when the toner is further consumed, and when only a smaller amount of toner remains in the toner chamber 27, the agitator 29 lifts up a smaller amount of toner. Accordingly, the light receptor 61 receives more amount of light, and as shown in FIG. 6(*d*), the low-level output signal is output for a longer time period than FIG. 6(*c*).

Referring to FIG. 6(*a*), in the toner-remaining-amount detection program, the remaining toner amount is detected by calculating a low-level ratio indicating a ratio of a time duration Ti of the low-level output signal to a predetermined rotation frequency T2 of the agitator 29. In the example of FIG. 6(*a*), the predetermined rotation frequency T2 is set to three complete rotations of the agitator 29. Specifically, when the low-level ratio exceeds 2%, such as in a situation shown in FIG. 6(*c*), it is determined that the remaining toner amount is low, and the LED of the operation panel 82 shows a warning indicating a user the low amount of remaining toner. When the low-level ratio exceeds 18%, such as in a situation shown in FIG. 6(*d*), it is judged that no toner is remaining. Then, the LED shows a warning indicating that there is no toner left, and also the main-motor 78 and the sub-motor 75 are stopped driving.

In this manner, the remaining toner amount is reliably and accurately detected by detecting the time duration of the light transmitting from the light generator 60 to the light receptor 61 or the time duration of the light being blocked from reaching the light receptor 61. It can be reliably and accurately detected whether the remaining toner amount is sufficient and so that no toner supply is necessary or insufficient so that the toner supply is necessary.

The operation of the toner-remaining-amount detection program is executed at the time of when a main power switch of the laser beam printer 1 is turned ON, at the beginning or end of print job, during the continuous image-forming operations, or at any other suitable timing.

According to the present invention, in order to improve the operation speed of the laser beam printer 1, the agitator 29 is rotated at a higher speed during the image forming operations, so that the toner efficiently circulates within the developing cartridge 36, and that an increased amount of the toner with efficient chargeability is supplied to the developing roller 22. This also prevents degraded toner from piling up, and so prevents improper image forming.

On the other hand, when detecting the remaining toner amount, the agitator 29 is rotated at a lower speed so as not to stir up the toner and to prevent clouds of toner from filling up the toner chamber 27.

More specifically, the agitator-control program stored in the ROM 80 changes the rotation speed of the agitator 29. The agitator-control program is executed in synchronization with the toner-remaining-amount detection program. When the toner-remaining-amount detection program is being executed, the agitator-control program controls the sub-motor 75 at a lower speed, thereby rotating the rotation shaft 26, i.e., the agitator 29, at a lower speed. On the other hand, when the toner-remaining-amount detection program is not being executed, the agitator-control program controls the sub-motor to rotate at a higher speed, thereby rotating the rotation shaft 28, i.e., the agitator 29, at a higher speed. For example, the agitator 29 may rotate at the higher speed of 90.1 $min^{-1}$, and at the lower speed of 45.5 $min^{-1}$, which is half the higher speed.

Accordingly, although the cloud of toner may fill up within the toner chamber 27 during the image forming, the cloud of toner will not be formed during the toner amount detection. Therefore, accurate detection of the toner amount can be reliably performed. This is particularly important when the polymerized toner is used. Because of its excellent fluidity, the polymerized toner more likely forms the clouds.

Also, because the developing roller 22 is driven rotated by the main-motor 78 that is separated and independent from the sub-motor 75 for driving the agitator 29, change in rotation speed of the agitator 29 does not influence on the developing roller 22. That is, even when the rotation speed of the agitator 29 is changed, the rotation speed of the developing roller 22 is maintained constant. Therefore, redundancy on the photosensitive drum 21 is prevented, and an electrostatic latent image is formed on the photosensitive drum 21 in a reliable manner, thereby enabling preferable image forming.

It should be noted that when the agitator 29 is rotated at the lower speed for a long period of time during the continuous image forming in order to detect the toner amount during the continuous image forming, toner circulation within the developing cartridge 36 will be insufficient. This reduces the charging efficiency of the toner, and toner supply to the developing roller 22 will be insufficient, thereby degrading formed image quality.

In order to avoid these problems, according to the agitator-control program and the toner-remaining-amount detection program of the present embodiment, the time duration for driving the agitator 29 at the lower speed, i.e., the time duration for detecting the remaining toner amount, during the continuous image forming is set shorter than the time duration required to form images on a half the printing region on the recording sheet 3. For example, in the present embodiment, the agitator-control program controls the agitator 29 to rotate three times during the toner amount detection, and the time duration equivalent to three complete rotation of the agitator 29 is set for the toner-remaining-amount detection program. It should be noted that the continuous image forming includes the continuous printing in a single print job, and also the continuous printing in a plurality of print jobs.

Because the time duration for rotating the agitator 29 at the lower speed is set shorter than the time duration to form images on half the print region of the recording sheet 3, undesirable effects of the lower speed rotation of the agitator 29 on the image quality will be greatly reduced. Therefore, even when the continuous image forming is performed, preferable images can be formed while the toner amount is reliably detected.

Also, because the developing roller 22 and the agitator 29 are rotated independent from each other, when the developing cartridge 36 is mounted on a laser beam printer where the image forming speed, that is, the developing speed differs from that of the laser beam printer 1 of the present embodiment, the rotation speed of each the developing roller 22 and the agitator 29 can be controlled optimal for the laser beam printer, thereby enabling preferable image forming.

As described above, according to the present embodiment, the remaining toner amount is accurately and reliably detected while improving the image-forming operation speed of the laser beam printer 1.

While some exemplary embodiments of this invention have been described in detail, those skilled in the art will recognize that there are many possible modifications and variations which may be made in these exemplary embodiments while yet retaining many of the novel features and advantages of the invention.

For example, in the above-described embodiment, the agitator 29 and the developing roller 22 are driven to rotate by the sub-motor 75 and the main-motor 78, respectively, so as to rotate the agitator 29 and the developing roller 22 independent from each other. However, any configuration is conceivable as long as the agitator 29 and the developing roller 22 are unconnected with each other. For example, the sub-motor 75 can be dispensed with, and the driving force of the main-motor 78 can be transmitted both to the agitator 29 and the developing roller 22 via a speed changer provided for the agitator 29. The speed changer may be a gear, a clutch, a solenoid, or the like.

Also, although the photosensor 62 is provided to the laser beam printer 1 in the above described embodiment, the photosensor 62 can be formed to the toner chamber 27 of the developing cartridge 36. In this case, the light emitting element of the light generator 60 and the light receiving element of the light receptor 61 are positioned immediate outsides of the light transmission windows 58 and 59, respectively.

What is claimed is:

1. An image forming device comprising:

a chamber that houses a developing agent;

a holding member that is rotatable and holds the developing agent;

an agitator that is provided within the chamber, agitates the developing agent, and supplies the developing agent to the holding member, wherein the holding member and the agitator rotate independent from each other; and an agitator driving mechanism that drives the agitator to rotate at different speeds, wherein the agitator driving mechanism is able to change the rotational speed of the agitator with respect to a rotational speed of the holding member.

2. A developing cartridge used in the image forming device of claim 1, comprising a sensor that includes a light generating element for generating a light and a light receiving element for receiving the light for detecting an amount of developing agent, the developing cartridge comprising:

the chamber;

the holding member; and the agitator.

3. The developing cartridge according to claim 2, wherein the chamber is formed with a light transmitting path along which a light transmits through the chamber.

4. The developing cartridge according to claim 3, wherein when the agitator rotates, the agitator periodically blocks the light transmitting path.

5. The developing cartridge according to claim 4, further comprising windows formed to the chamber, wipers that clean the corresponding windows, and a rotation shaft that supports the agitator, wherein the windows define the light transmitting path such that the light generated by the light generating element passes through the windows and reaches the light receiving element, and the rotation shaft further supports the wipers.

6. The developing cartridge according to claim 2, further comprising a blade that rubs the developing agent onto the holding member so as to form a thin-thickness layer of the developing agent on the holding member, wherein the developing agent is a single-component non-magnetic agent.

7. The developing cartridge according to claim 2, wherein the developing agent is a polymerized toner produced by polymerizing polymerizable monomer.

8. The developing cartridge according to claim 2, further comprising a driving mechanism that drives each of the holding member and the agitator to rotate independent from each other.

9. The developing cartridge according to claim 2, wherein the holding member and the agitator are unconnected with each other.

10. The image forming device according to claim 1, further comprising an image forming mechanism that performs an image forming operation for forming images on a print region of a recording medium, and a sensor that detects an amount of the developing agent remaining in the chamber, wherein the agitator driving mechanism drives the agitator to rotate at a higher speed when the image forming operation is being performed, and drives the agitator to rotate at a lower speed when the sensor detects the amount of the developing agent.

11. The image forming device according to claim, 10, wherein the image forming mechanism requires a first time duration for forming images on half the print region of the recording medium, and the agitator driving mechanism drives the agitator at the lower speed for a second time duration, wherein the second time duration is shorter than the first time duration.

12. The image forming device according to claim 1, further comprising a holding member driving mechanism that drives the holding member to rotate, the holding member being provided independent from the agitator driving mechanism.

13. The image forming device according to claim 1, further comprising a sensor that detects an amount of the developing agent remaining in the chamber, the sensor including a light generating element for generating a light and a light receiving element for receiving the light, wherein the light generated by the light generating element transmits through the chamber and reaches the light receiving element.

14. The image forming device according to claim 13, wherein when the agitator rotates, the agitator periodically blocks the light from reaching the light receiving element.

15. The image forming device according to claim 14, further comprising windows formed to the chamber, wipers that clean the corresponding windows, and a rotation shaft that supports the agitator, wherein the light generated by the light generating element passes through the windows and reaches the light receiving element, and the rotation shaft further supports the wipers.

16. The image forming device according to claim 1, further comprising a blade that rubs the developing agent onto the holding member so as to form a thin-thickness layer of the developing agent on the holding member, wherein the developing agent is a single-component non-magnetic agent.

17. The image forming device according to claim 1, wherein the developing agent is a polymerized toner produced by polymerizing polymerizable monomer.

18. A developing cartridge used in the image forming device of claim 1, comprising:

the chamber;

the holding member;

the agitator; and windows formed to the chamber, the windows defining a light transmitting path.

19. An image forming device comprising:

a chamber that houses a developing agent;

a holding member that rotates and holds the developing agent;

an agitator that rotates within the chamber to agitate the developing agent, and supplies the developing agent to the holding member;

a sensor that detects an amount of the developing agent remaining in the chamber; and an image forming mechanism that performs an image forming operation, wherein the agitator rotates independent from the holding member, the agitator rotating at a lower speed when the sensor detecting the amount of the developing agent than when the sensor is undetecting the amount of the developing agent.

20. The image forming device according to claim 19, wherein the holding member rotates at a constant speed regardless of the rotation speed of the agitator.

* * * * *